US005960598A

United States Patent [19]

Tamlyn

[11] Patent Number: 5,960,598

[45] Date of Patent: Oct. 5, 1999

[54] BUILDING CONSTRUCTION INSIDE CORNER EXCLUDING WATER ENTRY

[76] Inventor: John Thomas Tamlyn, 10406 Cash Rd., Stafford, Tex. 77477-4492

[21] Appl. No.: 08/900,172

[22] Filed: Jul. 25, 1997

[51] Int. Cl.[6] ..... E04C 2/32; E04B 2/02

[52] U.S. Cl. ..... 52/254; 52/273; 52/287.1

[58] Field of Search ..... 52/254, 255, 273, 52/287.1, 417

[56] References Cited

U.S. PATENT DOCUMENTS

| | | | |
|---|---|---|---|
| 3,206,806 | 9/1965 | Powell | 52/241 X |
| 4,196,553 | 4/1980 | Veach | 52/287.1 X |
| 4,706,426 | 11/1987 | Rumsey | 52/255 X |
| 5,203,640 | 4/1993 | Pourtau et al. | 52/287.1 X |
| 5,531,051 | 7/1996 | Chenier, Jr. et al. | 52/257 X |
| 5,551,201 | 9/1996 | Anderson | 52/287.1 X |
| 5,740,642 | 4/1998 | Koenig, Jr. et al. | 52/255 |
| 5,813,179 | 9/1998 | Koenig, Jr. et al. | 52/255 |

*Primary Examiner*—Carl D. Friedman
*Assistant Examiner*—Kevin D. Wilkens
*Attorney, Agent, or Firm*—Gunn & Associates, P.C.

[57] ABSTRACT

An inside strip which is installed at the inside corner of a typical frame construction building having an external veneer. The framing defines a corner post with framing extending behind two walls at right angles. The two walls are covered with an external veneer such as a sheet layer or horizontal or vertical planking. At the inside corner to exclude the intrusion of water which might otherwise cause rotting, an inside strip is installed. It has the shape of a W-fold defining a center edge which is located at a position typically exposed along the inside corner. The elongate strip of W-fold construction includes outer marginal rectangular faces which are caught behind the wall during construction so that the strip is held in position to protect against the entry of water and inclement weather at the inside corner.

20 Claims, 1 Drawing Sheet

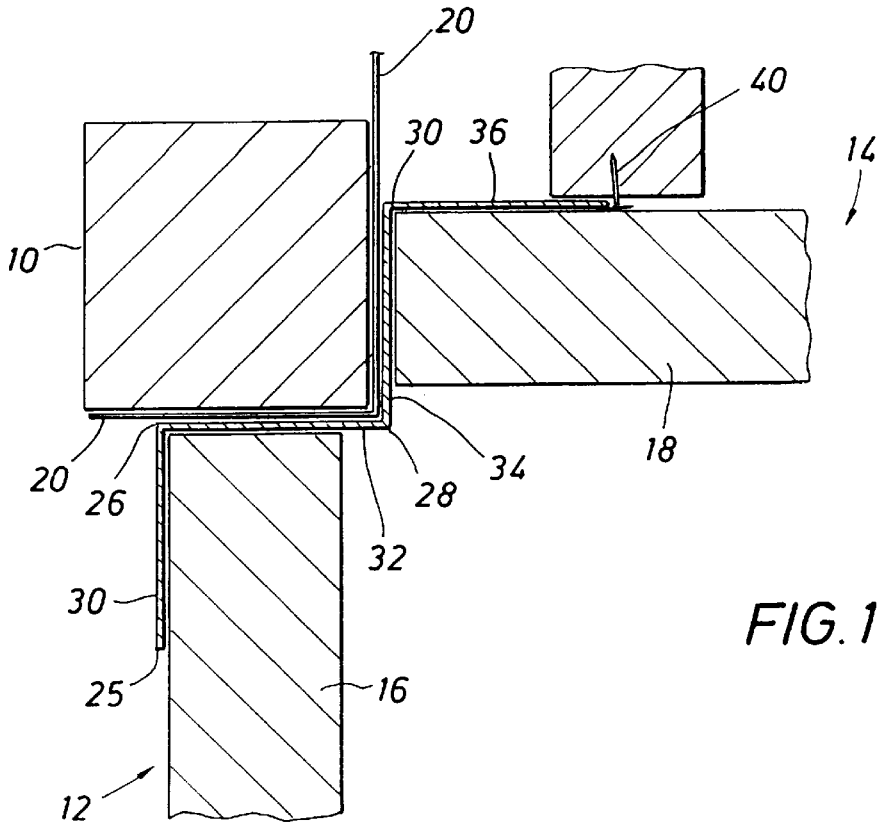
FIG. 1
FIG. 2
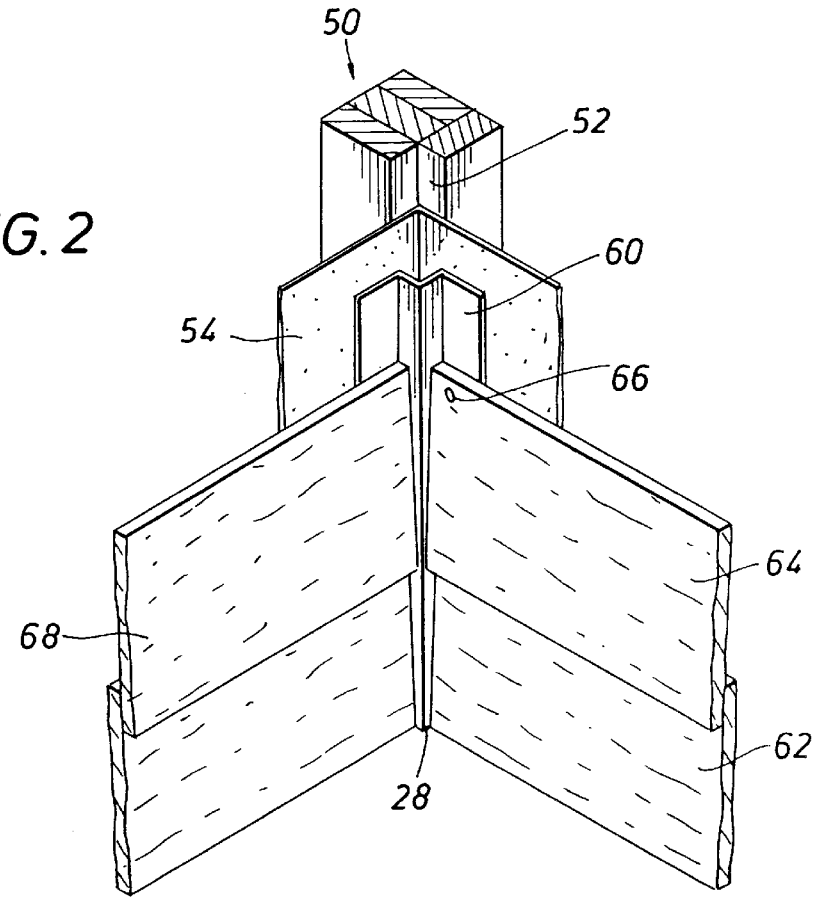

BUILDING CONSTRUCTION INSIDE CORNER EXCLUDING WATER ENTRY

BACKGROUND OF THE DISCLOSURE

The present disclosure is directed to an inside corner construction and more particularly to an inside corner insert which excludes water. To provide the context, consider residential construction in which an inside corner of exterior walls is defined at the front porch. The inside corner is formed at the vertical intersection of two side walls. Typically, the side walls are formed with planking, and the planking, whether horizontal or vertical, is terminated at the inside corner with some sort of decorative bead, strip or other added cover thereby enabling relatively neat construction. Ordinarily, the structure is framed with wood framing, typically 2×4 framing members being installed for support on the backside of the planking. Wood, however, in many parts of the U.S., is susceptible to termite destruction. In all parts of the country, wood is susceptible to rotting with age. To be sure, a high quality coat of paint with appropriate caulking applied at the seams will reduce the wood rot with water and might slow termite entry. However, both risks pose an aging problem. Recently, new types of planking have been furnished which have a much greater life. Indeed, the life of the planking has been extended by many years by the construction of the planking in sheet form which is generally known as fiber-cement siding. One brand of such siding is the product known as HARDIPLANK® lap siding, a registered trademark of James Hardie & Coy. Pty. This is a very successful product which is formed as 4×8 sheets in selected widths of up to 12' length lap siding. Primarily, it is formed of cement and has imbedded fibers in it which provide strength. It is a product furnished with a 50 year warranty. It has the advantage of being stable in size and will not swell or shrink with water content. Because it is stable in size, the paint on the skin is therefore maintained stable and there is substantially longer life to the paint because it will not crack or craze with dimensional changes inherent in wood. This is a very great advantage. Moreover, it is not digestible to termites and therefore can be deemed as a termite proof material.

The enhanced life for the external, wood appearing planking which is formed of the fiber-cement product is especially attractive. Because it is a non-combustible product, resists moisture, is not susceptible to cracking, rotting or other deterioration, and is immune to termite invasion, the product has been substantially accepted and is able to cover most of the exterior of a building. Troubles, however, arise at wet areas where water gets behind the fiber-cement exterior, and starts a rotting problem. The inside corner of exterior walls at a porch or other inside corners about residential construction pose such a risk. Water splashed on the inside corner can readily enter at the corner and damage the wood framing members behind the corner. Then, problems arise ultimately requiring some kind of repair at the corner. Even where the repair is relatively simple, it cannot be done easily because there is an access problem. Access can be obtained by removing the fiber-cement planking on the exterior. Whether it is provided in the form of a board or large sheet, it is not easily removed and restored. Therefore, water damage repair is highly detrimental and usually expensive.

Positioning a wood strip in the corner provides only superficial help. The strip can be a simple 1×2 trim strip, or 2×4 or other wood piece(s). Those strips, while not load bearing, are still exposed and will ultimately deteriorate and require replacement. Even with the addition of caulking material on the adjacent seams (one on the left and the second on the right), and caulking with high quality resilient caulk, protection can be obtained but only for a short while. Eventually, the caulking material will dry and become brittle allowing water to penetrate the wood components of the inside corner and cause the structure to rot The present disclosure sets forth an inside corner shield for exterior walls which can be incorporated at that location. Cosmetically, the shield is mostly not in view but, where in view, it can readily be painted or otherwise colored so that it provides the desired attractive nature. Moreover, the inside corner construction of the present disclosure excludes water entry so that the wood framing members on the backside of the walls and especially at the corner are protected from water damage. This protection is highly desirable so that the life of the frame will match the 50 year life of the fiber-cement planking on the exterior walls.

The present apparatus comprises a W-shaped strip as more precisely defined below and is formed of vinyl, preferably PVC, and is fabricated with a color pigment in it (normally white). It is inserted at the corner so that the planking on the two corner walls overlaps secure the W-shaped strip firmly in place. It can readily be nailed but the nails do not define water entry points because the nails are covered after the planking has been installed. This will protect on the interior and prevent subsequent water entry. As will be detailed, the corner strip of the present disclosure is effective in all circumstances and will especially succeed in excluding rain, and yet can be used successfully with any color finish and any type of outer surface planking on the walls defining the inside corner.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may add to other equally effective embodiments.

FIG. 1 is a sectional view through an inside corner showing the inside corner strip of the present disclosure installed adjacent to a framing member and walls at the corner;

FIG. 2 shows an inside corner construction in perspective with portions of the planking removed and illustrates an alternate form of framing utilizing the inside strip of the present disclosure; and FIG. 3 shows a vertical overlap of two pieces of inside corner strip.

DETAILED DESCRIPTION OF THE PREFERRED EMBODIMENT

Attention is directed to FIG. 1 of the drawings for a description of the inside corner construction of exterior walls which will be given first. An alternate construction is shown in FIG. 2 of the drawings. The two constructions are relatively similar but they can readily differ in details with regard to framing. Accordingly, many framing techniques can be implemented using the present disclosure. Going immediately to FIG. 1 of the drawings, the numeral 10 identifies an upright frame member at the inside corner.

Commonly, the frame member 10 is formed of two or more vertically deployed studs. They are most often a 2×4, or 2×6 or some mix of them. The common mode of construction is to install wall studs 10' at spacing which ranges anywhere from about 16 inches to about 24 inches. Again, the wall studs are normally vertical 2×4 studs of appropriate height to define the two walls. As shown in FIG. 1, there is a first wall 12 which is at right angles to a second wall 14. These are of any appropriate length and height although typical residential construction forms the walls to about 8 feet. The studs are typical and accordingly they can have any length just as the walls 12 and 14 can have any appropriate size. The numerous studs making up the walls 12 and 14 have been omitted, and only two are shown for sake of simplicity. The studs, top and bottom plates, and all other components in the walls 12 and 14 thus comprise a portion of the structure and are particularly important in that they hold the planking in place. As shown in FIG. 1, the external surfaces of the walls that will be seen when completed are formed of first and second planking layers 16 and 18 affixed to the wall stud 10' by means of nail 41. They can be horizontal planking such as 6¼"×12' or 8¼"×12' construction. They can just as readily comprise vertically deployed composite sheets, typically 4×8. Plywood, particle board and other external surfaces can also be applied. However, it is of great significance that the fiber-cement composite materials have been quite successful recently and are markedly improved in performance at a competitive cost compared to wood and therefore that will be used as an example to explain the context. In that light, the fiber-cement components (whether individual planks or in sheet form and whether deployed horizontally or vertically) will be assumed to constitute the planking 16 and 18 in the two walls.

As shown in FIG. 1, the planks 16 and 18 come together at a corner where the corner must be protected against the intrusion of water and made decorative also. This type construction is essential to assure a support structure which will have as long a life as the fiber-cement products now being applied. Otherwise, the advantages of the fiber-cement planking will be lost because the remainder of the structure will rot and decay more rapidly. Worse than that, there will be dimensional changes dependent on seasonal rains, and the exposure to termites will be more risky. In this context, the inside corner construction shown in FIG. 1 preferably comprises the erection of the post 10 (recall that it is formed of a multiplicity of vertical studs) positioned there at the corner initially before the planking 16 and 18 is applied to the walls 12 and 14. Protection is enhanced by positioning a thin sheet of felt 20 which is positioned or installed at or next to the corner post 10. The felt material excludes water to some extent. It also prevents draft and air flow behind that area which would otherwise create a greater requirement for heat in the winter and air conditioning in the summer in most southern climates. The felt material 20 is positioned at the corner post 10 and is extended along the walls 12 and 14, typically enclosing the entire structure. At this preliminary stage of construction, the felt material 20 is applied in multiple layers which are overlapped and tacked into place temporarily and held before the planking is applied. Ultimately, however, the felt layer 20 is not seen from the exterior because it is completely on the inside of the walls.

The next step in construction is to position the protective inside strip of the present disclosure. That is indicated generally by the numeral 25 and comprises a W-shaped member as will be detailed. As shown in FIG. 1, the inside corner 25 has a finite thickness. The felt layer 20 is normally about the same thickness but is formed of a readily pliable sheet material. Felt paper has a measure of stiffness; the inside corner strip 25 is preferably much stronger and stiffer. Specifically, the inside corner of the present construction is shaped in the form of a W that defines three corners 26, 28 and 30. All three corners are at right angles. The inside strip 25 is constructed of a material to be described having a thickness in the range of about 4 to about 10 mils (0+5 thickness is acceptable). While it can be made thicker, there is no special benefit so that the thickness is constrained to avoid wasting material. The three corners are defined by the appropriate intersections with the illustrated four planar segments 31, 32, 34 and 36. For symmetry, the planar segments 31 and 36 are equal in width, and the planar segments 32 and 34 are equal in width. They are all formed to the same thickness. This is in the form of a strip of any length; since most walls are 8 feet in nominal height, 10 foot strips are made to assure extra length. However, if the strip is longer or shorter, it can still be successfully used. Whether longer or not, strips can be abutted against the post 10 and can be overlapped as shown in FIG. 3. The lap joint 51 should position the lower strip 25" of the present invention under or covered by the lapped upper strip 25'.

The inside corner strip of the present invention is formed of a PVC material which is extruded to the thickness mentioned. It is preferably formed with a color pigment in it. The most common color is white to enable painting to any building color selected. Also, it is formed with granulated ultraviolet inhibitors distributed through it which serves as an ultraviolet light blocker so that it does not readily crack or craze when exposed to direct sunlight. With a thickness of perhaps 4 to 6 mils, it is relatively flexible and easily handled and yet it withstands substantial abuse. It will flex back to its molded shape readily even when bent or dimpled. It will flex and return to its illustrated and original shape after deformation has ended. As will be understood, this is highly desirable so that the strip is protective of the structure.

Normally, no nails are driven through the strip of the present disclosure to hold it in place over the felt layer 20. A nail 40 can be driven into the post 10 through an edge located tab or can be located at the edge of the strip and driven into an adjacent stud member 10' (see FIG. 1) to hold it in the desired locations. Other nails along the edge can be added as required. In the typical construction sequence, the felt paper is positioned first and then the strip material of this invention is temporarily nailed in place. Thereafter, the planking 16 and 18 is added so that the two walls are completed. The planks overlap and thereby hold in place the corner strip of the present invention. Once the planking 16 and 18 has been added, this assembly will define the corner 28. The corner 28 can be primed and painted where exposed while painting the planking 16 and 18. This provides a more attractive construction. While optional, if one elects, caulking material can be placed at the seams adjacent to the planking 16 and 18. It is not needed for any significant purpose other than enhancing the finish appearance. The strip material of the present invention provides a weatherproof corner and especially protects the post 10.

As noted above with regard to FIG. 1, the post 10 can be formed of one frame member or multiple studs. A typical construction for the post 50 is shown in FIG. 2. This defines an inside corner 52' where the post 50 is fabricated out of a number of studs. The prospective view also incorporates a sheet 54 of felt material as before. The felt material may well be extended along and adjacent to the two walls. In other words, the felt material 54 may be folded at a crease in the corner, and then extended behind the two respective walls.

The inside corner strip 60, of the present invention, is installed at that location on top of the felt material 54. After that, the two walls are then covered with appropriate planking. A first plank 62 is attached to the exterior one wall and the next plank 64 is lapped over it and held in place by suitable nails 66. Planking is extended to the full height of the exterior of the wall. This type construction is carried out on the right of FIG. 2 for one wall and is provided on the left wall by similar construction techniques. The left wall includes the plank 68. The planks are replicated until the full height of the wall is constructed. As will be observed in FIG. 2, the nail 66 fastens and holds the plank 64. It passes through the inside corner strip 60 (near the outside edge) of this invention and is nailed into the post 50 or other frame member. In this particular instance, the post 50 has an exposed face 52 which receives the nail 66. As further shown in FIG. 2, the inside corner strip 60 has the exposed corner 28 which extends visibly from bottom to top as illustrated. This construction of the inside strip with a different type corner post is representative of the forms of construction which can be implemented. Moreover, this type construction is often encountered where the corner post 50 is formed of several studs cooperatively defining the post.

The inside strip construction ultimately consummated in the examples shown in FIGS. 1 and 2 overcomes a weak link. It then provides a surface which is especially useful with the fiber-cement planking. This type construction is advantageous for a number of reasons. Metal is relatively undesirable because it typically will rust where it has a ferrous content. Aluminum will not rust, but aluminum has an undesirable electrolysis reaction with fiber-cement materials. This is detrimental to the performance of the materials. To avoid that problem, the present apparatus is preferably formed of long chain polymers, to be more specific, polyolefins, and the preferred forms is specifically polyvinyl chloride (PVC). Because it is not load bearing, great strength is not required and more expensive materials are not needed. In addition to that, the inside corner strip of the present disclosure exclude the intrusion of water or water vapor for the life of the structure. Aging, rotting and deterioration of the inside corner strip and adjacent framing are avoided.

While the foregoing sets out preferred embodiments, the scope is determined by the claims which follow.

I claim:

1. An inside corner strip for building construction wherein the strip comprises:

(a) an elongate W-fold, flexible strip formed of thin, water impervious, plastic material of a constant thickness;

(b) said strip defining first and third strip edges evenly spaced from a center edge;

(c) first and second planar, marginal, edge located, rectangular faces along said strip and respectively located outside of and adjacent to said first and third edges;

(d) wherein said center edge is defined by third and fourth rectangular faces deployed at a right angle to each other and abutting each other and thereby defining said center edge; and (e) wherein said inside corner strip is adapted to attach to an inside corner in frame construction so that the frame construction defining the inside corner is located behind and covered over by said strip to exclude inclement weather from the framing there behind.

2. The inside corner strip of claim 1 wherein said strip is adapted to attach vertically and adjacent to a corner post in the frame construction, and said first and second marginal rectangular faces are deployed at a right angle with respect to each other, and said first and second marginal faces are adapted to be positioned behind veneer covering on the framing so that the framing and the veneer cover define intersecting walls at the inside corner.

3. The inside corner strip of claim 2 wherein said strip is formed of PVC and is non load bearing when installed with the framing to exclude the intrusion of water and thereby protect framing there behind.

4. The inside corner strip of claim 3 wherein said center edge is symmetrically flanked and adjacent to said third and fourth rectangular faces, and said third and fourth rectangular faces are of equal width, and said marginal rectangular faces are equal in width.

5. The inside corner strip of claim 4 wherein said center edge is exposed after installation and is formed of PVC having UV protection therein.

6. The inside corner strip of claim 4 wherein said strip is defined by said four faces and said first and third faces are at a right angle.

7. An inside corner construction in a framed building comprising:

(a) first and second walls at a right angle;

(b) framing behind said walls which comprises framing for holding said walls at the right angle and further including an inside corner post framed therein, and said corner post is located on the inside at the intersection of the first and second walls;

(c) an inside strip (i) having first and second wall rectangular faces, (ii) having third and fourth wall rectangular faces wherein said third and fourth wall rectangular faces are at right angles to each other and are of equal thickness and abut each other and said third wall rectangular face is parallel to said first wall rectangular face, and said third wall rectangular face abuts a first side of said corner post and said fourth wall rectangular face abuts a second side of said corner post, and (iii) said inside strip being located at the inside corner and said first and second faces thereof extending along said first and second walls so that said strip is captured by said walls; and (d) wherein said inside strip protects the corner post from the intrusion of inclement weather including water at the inside corner.

8. The inside corner construction of claim 7 wherein said abutting third and fourth faces form a protruding elongate center edge and said edge is exposed at the end of said first and second walls.

9. The inside corner construction of claim 8 wherein each of said first and second walls comprises upright framing members and wall covering materials overlayed with overlapping planks, and further wherein said planks are nailed to the framing there behind, and said planks at the ends thereof define the inside corner and are positioned to the exterior of the inside strip to thereby capture the inside strip.

10. The inside corner construction of claim 9 wherein said wall construction comprises multiple framing members deployed in parallel adjacent positions to construct the corner post.

11. The inside corner construction of claim 10 wherein said corner post comprises multiple framing members and said first side of said corner post and said second side of said corner post are at least partially covered with felt paper and said inside strip is positioned on the exterior of the felt paper.

12. The inside corner construction of claim 10 wherein said inside strip is formed of two or more independently mounted strips arranged serially along said inside corner post.

13. The inside corner construction of claim 9 wherein said inside strip comprises:

(a) an elongate W-fold flexible strip formed of thin, water impervious, plastic material of a constant thickness;

(b) said strip defining first and third strip edges evenly spaced from a center edge;

(c) first and second planar, marginal, edge located, rectangular faces along said strip and respectively located outside of and adjacent to said first and third edges;

(d) wherein said center edge is defined by said third and fourth wall rectangular faces deployed at a right angle to each other and abutting each other and thereby defining said center edge, wherein said third rectangular face is deployed parallel to said first rectangular face; and (e) wherein said center edge is aligned with and extending along said inside corner post so that the framing is located behind and covered over by said strip to exclude inclement weather from the corner post there behind.

14. The inside corner construction of claim 13 wherein said inside strip is positioned vertically and adjacent to the corner post in the frame construction, and said first and second marginal rectangular faces are deployed at a right angle with respect to each other, and are further positioned behind said planks so that the framing and said planks define intersecting walls at the inside corner.

15. The inside corner construction of claim 14 wherein said inside strip is formed of PVC and is non load bearing when installed with the framing to exclude the intrusion of water and thereby protect framing there behind.

16. The inside corner construction of claim 15 wherein said center edge is symmetrically flanked and adjacent to said third and fourth rectangular faces, and said third and fourth rectangular faces are of equal widths and said marginal rectangular faces are equal in width.

17. The inside corner construction of claim 9 further wherein said protruding center edge is exposed at the end of said walls.

18. The inside corner construction of claim 17 wherein said walls are planks ending at said center edge.

19. An inside corner construction in a framed building comprising:

(a) first and second walls at a right angle;

(b) framing behind said first and second walls which comprises (i) framing for holding said walls at the right angle, and an inside corner post framed therein, wherein multiple framing members are deployed in parallel adjacent positions to construct the corner post, and said corner post is located on the inside at the intersection of the first and second walls, and (ii) upright framing members;

(c) wall covering materials overlayed with overlapping planks, wherein said planks are nailed to the framing there behind, and said planks at the ends thereof define the inside corner;

(d) an inside strip of constant thickness and having first and second wall rectangular faces, wherein said inside strip (i) is located at the inside corner and abuts said corner post, and said faces thereof extending along said first and second walls so that said strip is captured by said walls, (ii) has a protruding elongate center edge formed by third and fourth wall rectangular faces of said strip at a right angle to each other and said edge is exposed at the end of said first and second walls, and (iii) is formed of two or more independently mounted strips arranged serially along said inside corner post; and (e) wherein said inside strip protects the corner post from the intrusion of inclement weather including water at the inside corner.

20. The inside corner construction of claim 19 wherein said inside post and said framing members are at least partially covered with felt paper and said inside strip is positioned on the exterior of the felt paper.

* * * * *